US008978276B2

(12) United States Patent
Moon, Jr. et al.

(10) Patent No.: US 8,978,276 B2
(45) Date of Patent: Mar. 17, 2015

(54) SAFETY SYSTEMS FOR WIRELESS CONTROL FOR SNOW PLOWS

(71) Applicant: Northern Star Industries, Inc., Iron Mountain, MI (US)

(72) Inventors: James E. Moon, Jr., Crystal Falls, MI (US); Jody Christy, Iron Mountain, MI (US); Gary Laird Blank, Appleton, WI (US)

(73) Assignee: The Toro Company, Bloomington, MN (US)

( * ) Notice: Subject to any disclaimer, the term of this patent is extended or adjusted under 35 U.S.C. 154(b) by 129 days.

(21) Appl. No.: 13/778,365

(22) Filed: Feb. 27, 2013

(65) Prior Publication Data

US 2014/0049381 A1 Feb. 20, 2014

Related U.S. Application Data

(60) Provisional application No. 61/683,944, filed on Aug. 16, 2012.

(51) Int. Cl.
*E01H 5/04* (2006.01)
*G08C 19/16* (2006.01)
*G08C 17/02* (2006.01)

(52) U.S. Cl.
CPC ..... *G08C 17/02* (2013.01)
USPC ..... 37/234; 37/236; 340/12.5; 340/539.1

(58) Field of Classification Search
CPC ..... E01H 5/06; E01H 5/066; A01B 63/00; A01B 13/00; A01B 63/10; B60R 16/0315
USPC ..... 340/12.5, 425.5, 538.17, 539.1, 539.23, 340/568.2; 701/36; 37/234–238
See application file for complete search history.

(56) References Cited

U.S. PATENT DOCUMENTS

| | | | | |
|---|---|---|---|---|
| 4,062,135 | A | | 12/1977 | Dobberpuhl |
| 4,776,750 | A | | 10/1988 | Griswold, Jr. et al. |
| 5,361,519 | A | | 11/1994 | Ciula et al. |
| 5,420,480 | A | | 5/1995 | Knepel et al. |
| 5,512,892 | A | | 4/1996 | Corballis et al. |
| 5,524,368 | A | | 6/1996 | Struck et al. |
| 5,638,619 | A | | 6/1997 | Bowling |
| 5,704,429 | A | | 1/1998 | Lee et al. |
| 5,746,261 | A | | 5/1998 | Bowling |
| 5,884,206 | A | | 3/1999 | Kim |
| 5,894,688 | A | * | 4/1999 | Struck et al. ..... 37/271 |
| 6,005,300 | A | | 12/1999 | Kelly |
| 6,061,617 | A | | 5/2000 | Berger et al. |
| 6,085,846 | A | | 7/2000 | Buchl et al. |
| 6,112,139 | A | | 8/2000 | Schubert et al. |
| 6,154,122 | A | | 11/2000 | Menze |
| 6,163,985 | A | | 12/2000 | Chinnery et al. |

(Continued)

*Primary Examiner* — Eric M Blount
(74) *Attorney, Agent, or Firm* — Marshall, Gerstein & Borun LLP

(57) ABSTRACT

A safety system for a wireless snowplow controller makes the wireless controller safer and more effective. The system includes a vehicle, a snowplow, a wireless controller and a tether. The controller wirelessly sends one or more control signals to one or more control modules coupled to the vehicle and/or the snowplow. The control signals may be used to control operation of the snowplow. The controller may be configured such that it is only able to send control signals when it is connected, via the tether, to a power supply coupled to the vehicle.

4 Claims, 3 Drawing Sheets

(56) References Cited

U.S. PATENT DOCUMENTS

| | | | | |
|---|---|---|---|---|
| 6,323,759 | B1 * | 11/2001 | Menze | 340/425.5 |
| 6,396,210 | B1 | 5/2002 | Menze | |
| 6,504,306 | B2 | 1/2003 | Menze | |
| 6,542,789 | B2 | 4/2003 | Ufheil | |
| 6,662,881 | B2 | 12/2003 | Domann | |
| 6,715,696 | B2 | 4/2004 | Pierce | |
| RE38,665 | E | 12/2004 | Struck et al. | |
| 6,850,221 | B1 | 2/2005 | Tickle | |
| 6,852,934 | B1 | 2/2005 | Lashua | |
| 6,982,648 | B2 | 1/2006 | Cros et al. | |
| 7,084,570 | B2 | 8/2006 | Oyaski | |
| 7,089,721 | B2 | 8/2006 | Turner et al. | |
| 7,099,722 | B2 | 8/2006 | Casey | |
| 7,137,724 | B2 | 11/2006 | Menze et al. | |
| 7,349,772 | B2 * | 3/2008 | Delaney et al. | 701/2 |
| D567,243 | S | 4/2008 | Ashida et al. | |
| 7,400,058 | B1 | 7/2008 | Wayne et al. | |
| D594,066 | S | 6/2009 | Oikawa et al. | |
| D600,697 | S | 9/2009 | Swiader | |
| 7,586,050 | B2 | 9/2009 | Lashua | |
| 7,631,442 | B2 * | 12/2009 | Kost et al. | 37/234 |
| 7,665,233 | B2 | 2/2010 | Lemieux et al. | |
| D611,477 | S | 3/2010 | Brunner et al. | |
| 7,681,340 | B2 | 3/2010 | Treuthardt | |
| 7,762,698 | B2 | 7/2010 | Menze | |
| 7,798,278 | B2 * | 9/2010 | Tesinsky | 180/333 |
| 7,856,301 | B2 | 12/2010 | Sjogren et al. | |
| 8,068,961 | B2 | 11/2011 | Menze | |
| 8,162,521 | B2 | 4/2012 | Menze et al. | |
| 8,185,276 | B2 | 5/2012 | Buckbee et al. | |
| 8,695,238 | B2 * | 4/2014 | Warchola et al. | 37/234 |
| 2004/0164621 | A1 * | 8/2004 | Fu et al. | 307/117 |
| 2006/0016993 | A1 | 1/2006 | Zovich | |
| 2008/0073090 | A1 | 3/2008 | Harris | |
| 2008/0201994 | A1 | 8/2008 | Crago | |
| 2009/0119954 | A1 | 5/2009 | Lemieux et al. | |
| 2009/0309779 | A1 * | 12/2009 | Buckbee et al. | 341/176 |
| 2009/0312904 | A1 | 12/2009 | Menze | |
| 2010/0217475 | A1 | 8/2010 | Menze et al. | |
| 2010/0282586 | A1 * | 11/2010 | Chiu | 200/6 A |
| 2011/0100183 | A1 | 5/2011 | Tomaino | |

* cited by examiner

SAFETY SYSTEMS FOR WIRELESS CONTROL FOR SNOW PLOWS

CROSS REFERENCE TO RELATED APPLICATIONS

This application claims the benefit of U.S. Provisional Application No. 61/683,944, entitled "Safety Systems for Wireless Control for Snowplows" which was filed on Aug. 16, 2012, the entire disclosure of which is hereby incorporated by reference herein. Additionally, this application is related to U.S. patent application Ser. No. 13/778,357, entitled "Wireless Snow Plow Control" and filed concurrently herewith, the entire disclosure of which is hereby incorporated by reference herein.

FIELD OF THE DISCLOSURE

This disclosure relates to safety systems, and in particular, to safety systems for wireless snowplow controllers.

BACKGROUND

Typical snowplow control systems include a controller device within the cab of a vehicle, a wiring harness connecting the controller to the vehicle's electrical system and a plug plus one or more harnesses to connect the vehicle to a snowplow. The plug between the vehicle and snowplow harnesses is susceptible to weather and environmental conditions (e.g., snow, water, road salt) and is a common failure point in snowplow control systems. Replacing the wired controller with a wireless controller would eliminate this failure point. Additionally, by replacing the wired controller with a wireless controller, the wiring harness between the vehicle and plow may be eliminated, as the wiring between the vehicle and the plow may be reduced to only a power cable and a ground cable, as control signals from the controller are transmitted wirelessly. The use of a wireless controller would also allow the users increased flexibility in controlling the snowplow. For example, with a wireless controller, snowplow users may have the option of controlling the snowplow remotely while avoiding a common source of control system failure.

Wireless controllers, however, introduce their own set of issues, especially with respect to user safety. Because wireless controllers are free to operate outside the vehicle cab, the controllers may be especially prone to unintended use.

Wireless controllers may also be prone to accidental activation if a user does not realize that the controller is configured to operate the snowplow wirelessly. In this scenario, even a well-intentioned user may accidentally actuate the snowplow if he manipulates the controller within its wireless activation range.

Wireless controllers are also more susceptible to power management issues than wired controllers. More specifically, wireless controllers generally rely on internal batteries for power. Because of this, wireless controllers typically can only remain powered for a limited time before their batteries run out of energy. If a controller battery dies while a user is operating the snowplow, this may also lead to safety hazards, as it may not be possible to change the position of the snowplow (such as from a position that obscures the driver's view or from a position in contact with a road surface), as the controller will not function with a dead battery. In contrast, wired controllers often can draw power from and/or recharge themselves when plugged into another device, such as, for example, a snowplow or vehicle.

Without a proper safety system in place, wireless snowplow controllers may cause a number of safety hazards that may outweigh their benefits and limit their usefulness. While systems for limiting the range of wireless controllers have been implemented, they are flawed. For example, U.S. Pat. No. 6,112,139 to Schubert et al. describes a method to limit the spatial operating range of a wireless controller by configuring receiver circuitry, this method is flawed as, among other things, it still allows more than one controller within the operating range of the receiver to potentially control the snowplow.

SUMMARY

A system includes a vehicle, a snowplow, a wireless controller and a tether in communication with a power supply. The controller wirelessly sends one or more control signals to one or more control modules coupled to the vehicle and/or the snowplow. The control signals may be used to control operation of the snowplow. The controller may be configured such that it is only able to control the snowplow when it is connected, via the tether, to a power supply coupled to the vehicle.

DETAILED DESCRIPTION OF THE PREFERRED EMBODIMENTS

Figure 1:
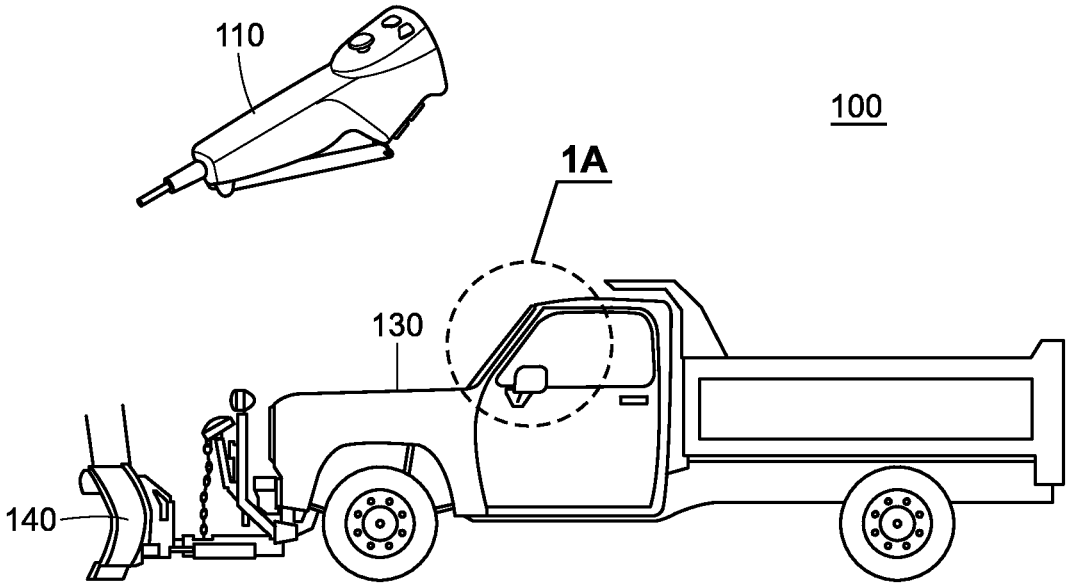
FIG. 1 is an environmental view illustrating a truck with a snowplow and a wireless snowplow controller.

A system of the present disclosure provides safety features for a wireless snowplow controller. The system may be redundant (i.e., there may be more than one safety option for the same controller) or may incorporate a single safety feature. Additionally, one or more safety features of the safety system may be turned on or off by a user.

Generally, the described system may be used to provide safety features for a wireless snowplow controller. The features may be used, for example, to prevent unauthorized or unintentional snowplow activation.

The snowplow control system may include a wireless controller and one or more control modules (e.g., a vehicle control module (VCM), and a plow control module (PCM)). The VCM may be installed in the engine compartment of a vehicle and may communicate with the PCM. The PCM may be self-contained on the snowplow.

The wireless controller may be physically tethered to the cab of a vehicle. The tether may be an electrical cable having a length such that the wireless controller cannot be taken outside the cab while the tether is still attached. The tether may be electrically connected to a power supply within the cab, such as a 12V socket provided as a standard feature of the vehicle. Additionally, the tether may be electrically connected to one or more batteries within a housing of the controller and used to power the controller, in such a manner as to charge the controller's battery or batteries while the controller is physically connected to the cab. Although the controller is physically and electrically connected to the cab via the tether, control signals between the controller and the PCM and the VCM may still be transmitted and received wirelessly (e.g., via RF, IR, etc.), and the controller may be powered independently of the tether for purposes of fulfilling its wireless transmissions.

Optionally, the controller may be configured such that it can control the snowplow even while the controller is not tethered to the vehicle cab. The configuration may be implemented via hardware, software, or a combination of hardware and software. As an additional safety feature, a user may be required to enter a password or code before the tethering requirement is overridden and the controller is allowed to perform control functions wirelessly.

The tethering feature may be combined with other safety features. For example, an infra-red system may be implemented such that the controller will not function if an infra-red signal between the controller and a vehicle sensor is lost. This infra-red system effectively limits the operating range of the wireless controller. Additionally, the sensor may be in communication with one or more sensors (e.g., ultrasonic or weight sensors) that can detect when a person is located within the cab of the vehicle. If the one or more sensors do not detect a person, the controller may not function. Additionally, an RF-proximity configuration may be implemented such that the controller will only function if it is closer to the vehicle than it is to the plow itself.

The described functionality can be implemented in a combination of hardware, software, and/or firmware on a wireless controller device and a tether.

Generally speaking, the systems and techniques of the present disclosure can be applied as part of a snowplow control system but may be used in the context of other vehicles or large controllable devices.

Figure 1A:
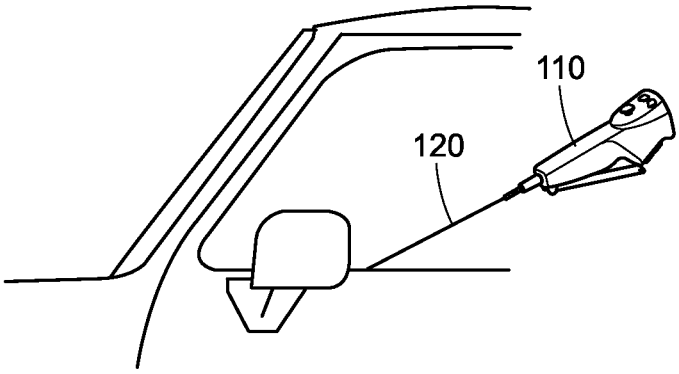
FIG. 1A is an enlarged view of the cab area of the truck, denoted by the broken-lined circle 1A of FIG. 1, illustrating the wireless snowplow controller tethered to the interior of the cab of the truck.

FIG. 1 is an environmental view of a truck equipped with a snowplow and a snowplow controller. The wireless control system 100 may include a wireless snowplow controller 110 (also referred to herein as a "controller"), a tether 120 (see FIG. 1A), a vehicle 130, and a snowplow 140. The controller 110 is for operator use and may typically be disposed within a vehicle cab and/or within an operator's reach while he is operating the vehicle. The snowplow 140 may be coupled to one or more modules that are in wireless communicative connection with the controller 110. More specifically, the module or modules may communicate with the snowplow 140 using wireless communications, packets, messages or signals from the controller 110 that correspond to one or more commands relating to one or more desired operations of the snowplow 140.

The commands may be used to activate or deactivate, and/or control various operations of elements of the snowplow 140. For example, the commands may activate and/or deactivate the appropriate snowplow valve or valves to perform blade operations (e.g., angle, raise, lower, or vee), hitch or connection operations (e.g., attach, detach) and/or pump operations (e.g., start, stop). Additionally, the commands may be used to operate or more plow lights mounted on the snowplow 140, such as a plow headlight, a plow turn signal, a plow reverse light, or a plow daytime running lamp. A PCM may be electrically connected (e.g., via wired, wireless or both wired and wireless connections) to at least one of a plow headlight, a plow turn signal, or a plow daytime running lamp. The PCM may provide signals to the one or more plow lights for operation (e.g., on, off, blinking, high or low beam, tilt, move).

Figure 2:
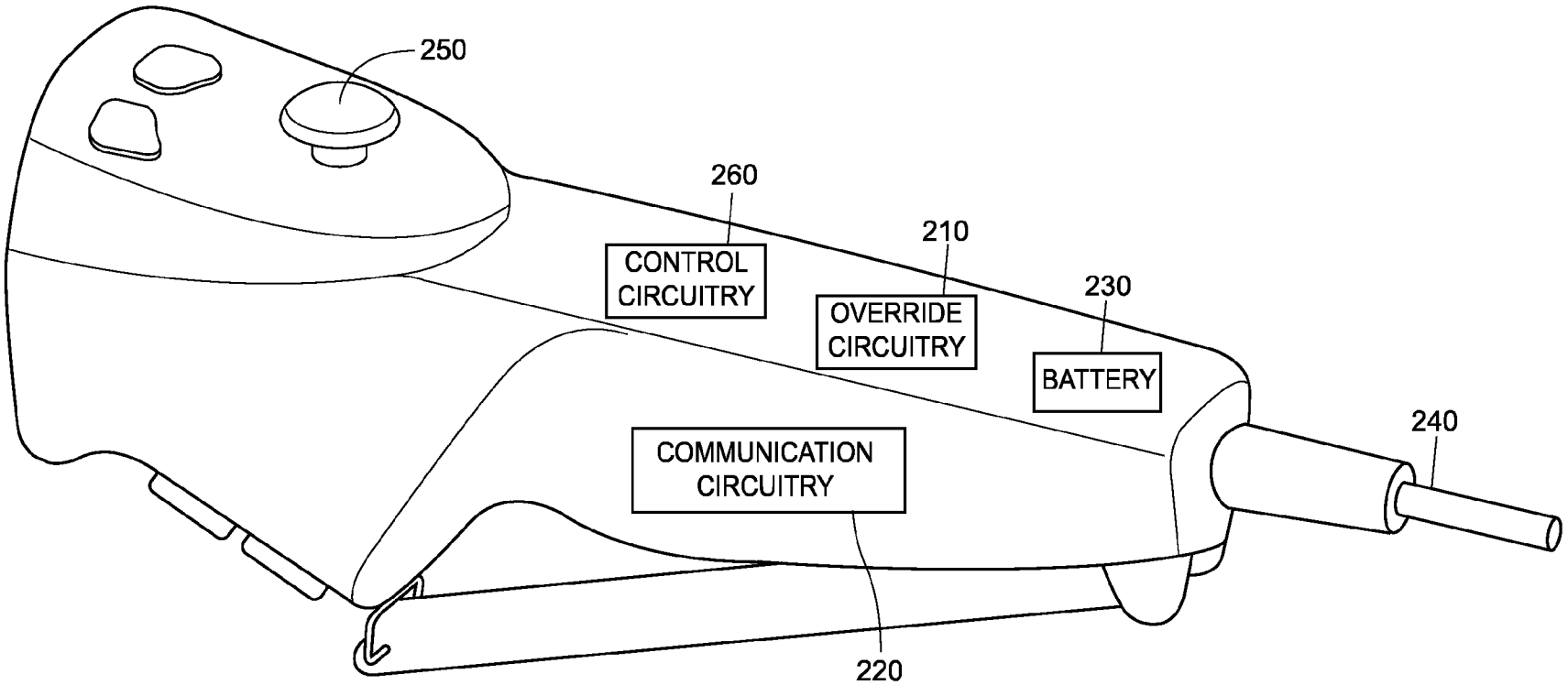
FIG. 2 depicts a wireless snowplow controller according to the present disclosure.

FIG. 2 is a block diagram detailing an exemplary embodiment of the wireless snowplow controller 110 according to the present disclosure. Controller 110 may include override circuitry 210, communication circuitry 220, battery 230 (which may include one or more batteries of either a single-use or, preferably, a rechargeable nature) and connector 240. The controller 110 may also include one or more user controls 250 that correspond to various desired operations of the snowplow 140. The one or more user controls 250 may be of any configuration or format, such as, for example, a joystick, toggle, push-button, dial, lever, touch screen, voice-activated control, and/or any other suitable user control. At least some of the one or more user controls 250 may correspond to desired snowplow operations, such as raise, lower, angle right, angle left, attach, detach, tilt, scoop, vee, or straight. Controller 110 may optionally be connected by tether 120 (not shown in FIG. 1) to an external power source such as a 12 volt power source or some other power source resident on the vehicle . While connected to the external power source, the controller 110's battery 230 may be charged by the external source. Additionally, the external power source may serve to power the controller 110 while the external source and the controller 110 are connected via tether 120 (not shown).

Figure 3:
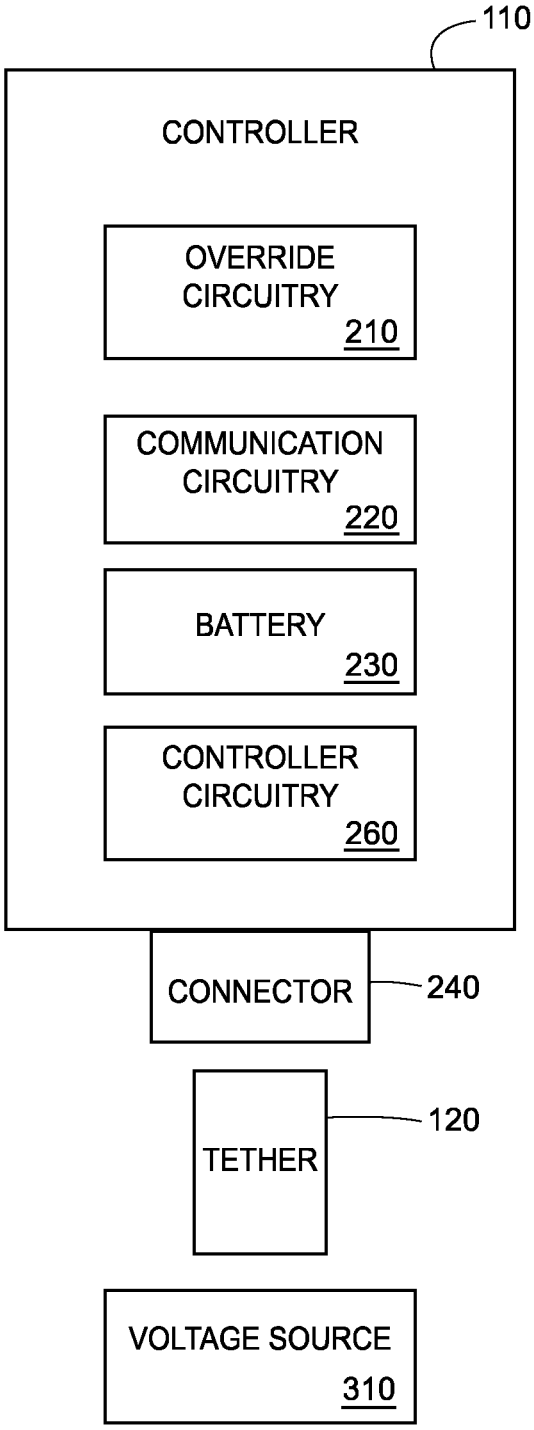
FIG. 3 is a block diagram of a controller-power source safety configuration according to the present disclosure.

FIG. 3 is a block diagram source safety configuration for a wireless snowplow controller according to the present disclosure. The safety configuration 300 may include controller 110, tether 120 and voltage source 310. As described above, controller 110 may include override circuitry 210, communication circuitry 220, battery 230, connector 240, and control circuitry 260. Override circuitry 210, communication circuitry 220, battery 230, connector 240, and control circuitry 260 may be separate modules or may be combined and may interact with each other and/or with other software, hardware, and/or firmware.

As discussed above, controller 110 may be physically tethered to the cab of a vehicle. The tether 120 may be an electrically conductive cable having a length such that the controller cannot be removed from an interior of the cab while the tether is still attached. The tether 120 may be electrically connected to voltage source 310 Although the controller 110 is physically and electrically connected to the cab via the tether 120, control signals between the controller 110 and the control module or modules may still be transmitted and received wirelessly (e.g., via RF, IR, etc.) using, for example, communication circuitry 330.

More specifically, while tethered to the vehicle 130, controller 110 may use communication circuitry 220 to transmit commands wirelessly to one or more module or modules that are coupled to the vehicle 130 and/or the snowplow 140. Although the controller 110 is physically connected to the vehicle via tether 120, the tether is not used to transmit control commands. Instead, the tether 120 may act as an effective switch. Through the use of control circuitry 260 and tether 120, communication circuitry 220 may be "switched off" if controller 110 does not detect a connection to an external power supply via tether 120. More specifically, tether 120 may be directly connected to control circuitry 260, effectively "closing the loop" between control circuitry 260 and communication circuitry 220. In certain implementations, if tether 120 is not directly connected to control circuit 260, the electrical circuit between the components may not complete, effectively turning off communication circuitry 220. Alternatively, even if there is an electrical connection between components in the absence of a tether connection, controller 110 may check for a tether connection before permitting the communication circuitry 220 to transmit signals. The check for the tether connection may be performed in a number of ways. For example, control circuitry 260 may be programmed and/or designed to detect different levels of current and/or voltage in controller 110 when the tether 120 is connected compared to when the tether is disconnected. Tether 120 may also be configured to transmit a signal to controller 110 when it is connected to an external power source. The signal may then be detected, for example, by control circuitry 260. After the tether 120 is detected, communication circuitry 220 may then be permitted to transmit control signals. In certain implementations, controller 110 may include an analog channel input configured to monitor voltage on tether 120 and/or at connector 240. The analog channel input may, for example, detect a change in voltage and/or an "open circuit" condition if tether 120 is not connected to an external power source. Upon detecting that tether 120 is not connected to an external power source, the controller 110 may instruct communication circuitry 220 not to wirelessly transmit commands. More specifically, the analog channel input may effectively cause another circuit to transmit an instruction signal or effectively "open the communication circuit" without the use of an instruction signal, preventing communication circuitry 220 from transmitting commands.

As discussed above, in certain implementations, communication circuitry 220 may be completely prevented from transmitting command signals if an external power supply connection is not detected, thereby preventing the wireless controller from actuating the snowplow 140 when not tethered to the external power supply via tether 120. Alternatively, controller 110 may only be able to transmit low-power or unrecognizable signals to the one or more modules coupled to the vehicle 130 and/or the snowplow 140, which may permit only limited functionality of the snowplow 140 (such as permitting only movement of wings of a Vee-blade snowplow, but not permitting raising and lowering of the snowplow).

In a preferred implementation, as described above, hardware and/or software on controller 110 will confirm that controller 230 is connected to an external power supply via tether 120 and/or that battery 230 is being charge. Alternatively, in certain implementations, a control module separate from controller 110 (e.g., a PCM or VCM) may confirm that battery 230 is being charged and that tether 120 is connected to both an external power supply and/or connector 240 before accepting control signals or implementing commands from controller 110. If the control module detects that battery 230 is not being charged and/or tether 120 is not properly connected, the control module may send or cause a message to be sent to the controller indicating that it will not accept and/or implement commands until tether 120 is properly connected and/or battery 230 is being charged.

Because controller 110 may supply its own power (i.e., battery 230 may provide the power required for control operations), controller 110 may only require a minimal amount of power from vehicle 130, as the vehicle may merely provide current to provide an electrical connection between the control circuitry 260 and communication circuitry 220. Accordingly, control circuitry 260 may be designed such that it draws a limited amount of current compared to traditional wired controllers. This may be implemented, for example, through the use of current limiting circuitry (e.g., a fuse, a resistor configuration, a current limiting diode, a capacitor configuration) Compared to traditional wired controllers, which may draw significant power from the power supply (e.g., the vehicle) to power controller operations, through the use of current limiting circuitry associated with control circuitry 260, controller 110 may be significantly less draining on the vehicle battery. While implementations in which voltage source 310 charges the battery 230 or another internal power source inside controller 110 may draw more power than implementations in which voltage source 310 does not charge the battery 230 or another power source, both implementations may still be energy efficient compared to traditional wired controllers. Alternatively, voltage source 310 may provide power to the controller 110, allowing control circuitry 260 to communicate with one or more control modules.

While the controller 110 may be powered independently of the tether for purposes of fulfilling its wireless transmissions, in certain implementations, tether 120 may optionally supply power to controller 110. Further, tether 120 may optionally charge or recharge the battery 230 while the controller 110 is physically connected to the cab.

As discussed above, controller 110 may be connected to an voltage source 310 via tether 120. Voltage source 310 may, for example, be a 12 volt power source (e.g., a cigarette lighter or internal battery) or some other power source resident in the cab of the vehicle 130 (e.g., a USB device connector, an A/C outlet, a radio connector, a phone connector). Further, while connected to the external power source, the battery 230 or another internal power source inside controller 110 may be charged by voltage source 310. Additionally, the voltage source 310 may serve to power the controller 110 while the external source and the controller 110 are connected via tether 120.

Optionally, the controller 110 may be configured such that the controller 110 can control the snowplow 140 even while it is not tethered to the vehicle cab. The configuration may be implemented via hardware, software, or a combination of hardware and software. As an additional safety feature, a user may be required to enter a password or code before the tethering requirement is overridden and the controller 110 is allowed to perform control functions wirelessly. These elements may be implemented using override circuitry 210. Override circuitry 210 may effectively override the "switching" functionality of tether 120 described above.

Additionally, the tethering safety system may be combined with other safety systems. For example, as discussed above, an infra-red system may be implemented such that the controller will not function if an infra-red signal between the controller 110 and a vehicle sensor is lost. This infra-red system effectively limits the operating range of the controller 110 by preventing it from operating if there is no direct path between the controller and the IR sensor Therefore, the controller 110 will not operate properly if it is outside the cab of the vehicle 130. Additionally, the sensor may be in communication with one or more sensors (e.g., ultrasonic or weight sensors) that can detect when a person is located within the cab of the vehicle 130. If the one or more sensors do not detect an operator inside the cab, the controller 110 may not function. An RF-proximity configuration may be implemented such that the controller will only function if it is closer to the vehicle 130 than it is to snowplow 140 itself.

What is claimed is:

1. A method for enabling operation of a snowplow by wireless operation comprising:

connecting a tether to a wireless controller and an external power supply;

confirming, using a control module coupled to the wireless controller, that the tether is connected to the wireless controller and the external power supply; and transmitting snowplow commands, using command circuitry coupled to the wireless controller, after confirming that the tether is connected to the wireless controller and the external power supply.

2. The method of claim 1 wherein connecting a tether to a wireless controller and an external power supply comprises connecting the tether to connector circuitry coupled to the wireless controller.

3. The method of claim 1, further comprising charging, via the tether, an internal power supply coupled to the wireless controller while the tether is electrically connected to the external power supply and to the connector.

4. The method of claim 1, wherein connecting the tether to the wireless controller and the external power supply completes an electrical circuit.

* * * * *